US005558372A

United States Patent [19]

Kapes et al.

[11] Patent Number: 5,558,372

[45] Date of Patent: Sep. 24, 1996

[54] INSIDE DOOR HANDLE TOGGLE RELEASE MECHANISM

[75] Inventors: Richard C. Kapes, Shelby Township; Dennis M. Feher, Washington, both of Mich.

[73] Assignee: Chrysler Corporation, Highland Park, Mich.

[21] Appl. No.: 368,282

[22] Filed: Jan. 3, 1995

[51] Int. Cl.[6] ..... L05B 63/20

[52] U.S. Cl. ..... 292/336.3; 292/DIG. 31; 292/DIG. 37

[58] Field of Search ..... 292/336.3, DIG. 37, 292/DIG. 31

[56] References Cited

U.S. PATENT DOCUMENTS

| | | | |
|---|---|---|---|
| 2,793,898 | 5/1957 | Roethel | 292/DIG. 37 X |
| 3,610,668 | 10/1971 | Tixier | 292/341.12 |
| 3,633,953 | 1/1972 | Gley | 292/DIG. 37 X |
| 3,908,149 | 9/1975 | Gergoe et al. | 292/DIG. 37 X |
| 3,993,338 | 11/1976 | Cherbourg et al. | 292/DIG. 49 X |
| 4,307,905 | 12/1981 | Poe et al. | 292/DIG. 31 X |
| 4,374,597 | 2/1983 | Mochida | 292/336.3 X |
| 4,872,366 | 10/1989 | Appleby et al. | 292/DIG. 31 X |
| 4,929,007 | 5/1990 | Bartczak et al. | 292/336.3 |
| 5,253,906 | 10/1993 | Rogers, Jr. et al. | 292/336.3 X |
| 5,308,126 | 5/1994 | Weger, Jr. et al. | 292/DIG. 37 X |

FOREIGN PATENT DOCUMENTS

| | | | |
|---|---|---|---|
| 320696 | 4/1957 | France | 292/DIG. 37 |
| 1269534 | 5/1968 | Germany | 292/DIG. 37 |

*Primary Examiner*—Steven N. Meyers
*Assistant Examiner*—Monica E. Millner
*Attorney, Agent, or Firm*—Thomas G. Pasternak

[57] ABSTRACT

A toggle release mechanism for a vehicle door latch control assembly including an actuating member having a thumb actuated release button molded thereon. The mechanism includes a barrel-shaped roller snapped into the actuating member, first and second levers operatively connected at one end of each to a base member and pivotally snapped together at the other ends thereof. One of the levers is adapted to slide against the roller when the thumb button is depressed, moving the lever along the base member against the force of a coil spring connected between the base member and the lever. The lever provides a connection for a cable extending to operatively connect to a vehicle sliding door control assembly.

10 Claims, 10 Drawing Sheets

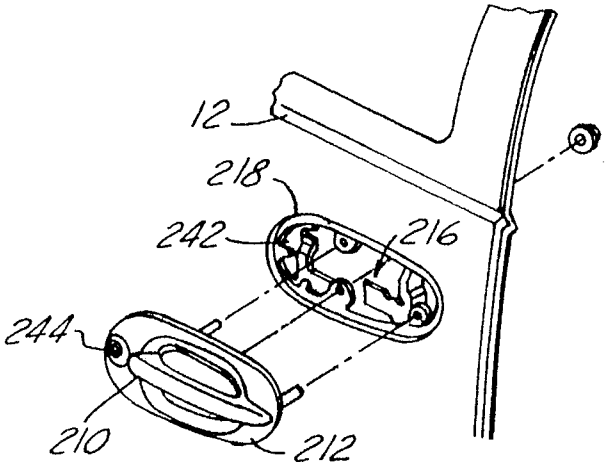
FIG. 1A
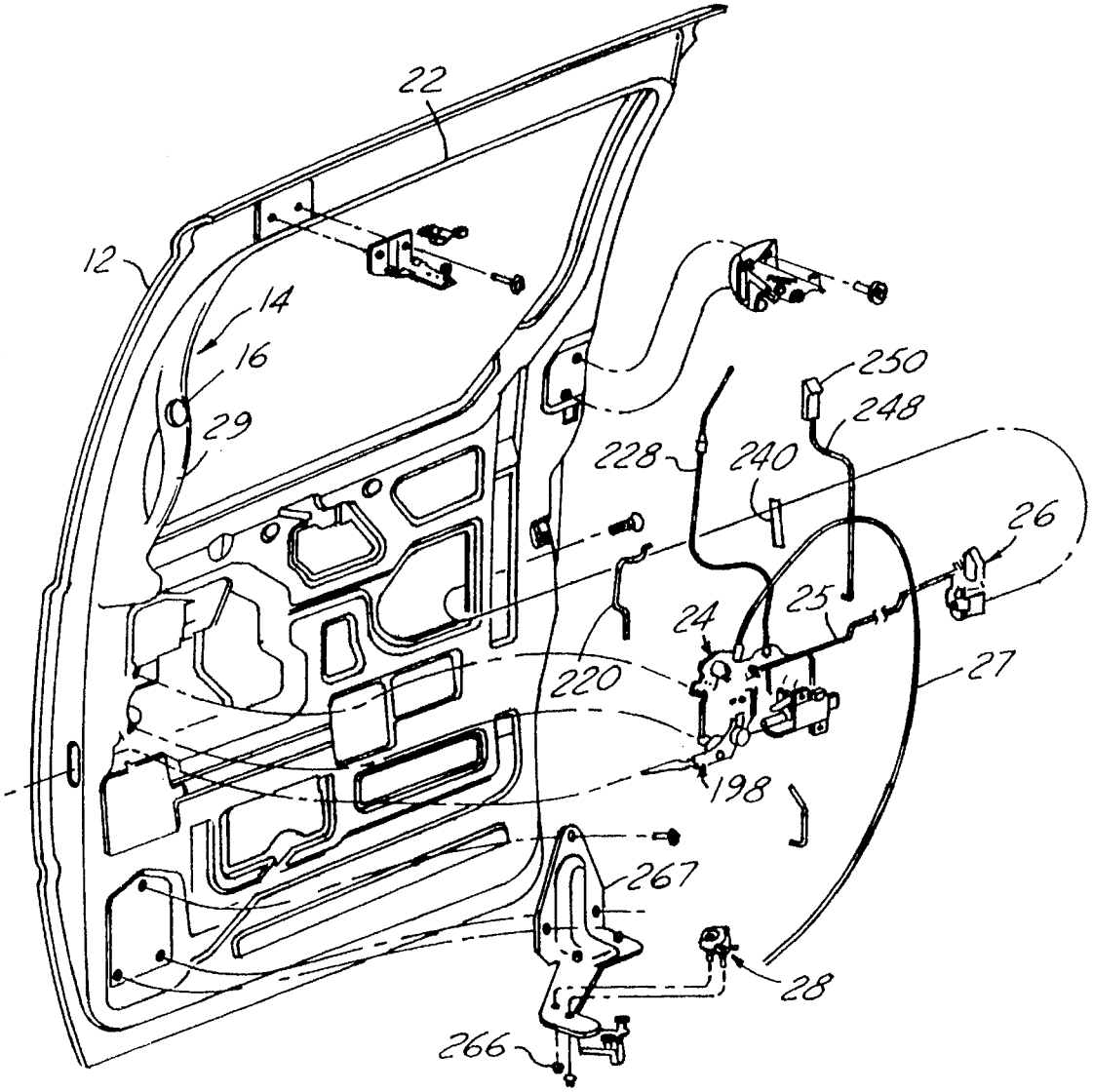

INSIDE DOOR HANDLE TOGGLE RELEASE MECHANISM

TECHNICAL FIELD

This invention relates generally to door latch releasing mechanisms and, more particularly, to vehicle inside door handle toggle type release mechanisms.

DISCLOSURE OF THE INVENTION

A general object of the invention is to provide an improved toggle release mechanism for a vehicle door latch control assembly.

Another object of the invention is to provide an improved toggle release mechanism for a latch control assembly, which includes minimal parts, all of which are readily snapped together to form the assembly.

A further object of the invention is to provide a toggle release mechanism mounted in an enclosure having a "grip" handle formed thereon, with an opening formed adjacent the upper end of the handle, through which a thumb actuated release button of the toggle release mechanism extends, with its outer surface substantially flush with the outer surface of the enclosure and handle.

Still another object of the invention is to provide a toggle release mechanism including five molded parts with provisions for snapping same together to become pivotally interlocked, and a coil spring connected between two of the parts urging the mechanism into a relaxed condition.

A still further object of the invention is to provide a toggle release mechanism including an actuating member having a thumb actuated release button molded thereon, a barrel-shaped roller snapped into the actuating member, first and second levers operatively connected at one end of each to a base member and pivotally snapped together at the other ends thereof, with one of the levers adapted to slide on the roller when the thumb button is depressed to move the lever along the base member against the force of a coil spring connected between the base member and the lever; the lever including provisions for the connection thereto of a cable extending therefrom to operatively connect to a vehicle sliding door control assembly.

These and other objects and advantages will become more apparent when reference is made to the following drawings and the accompanying description.

BRIEF DESCRIPTION OF THE DRAWINGS

FIG. 1A is an exploded perspective view of the side sliding door of FIG. 1 embodying the invention, including the outside door handle;

BEST MODE OF CARRYING OUT THE INVENTION

Figure 1:
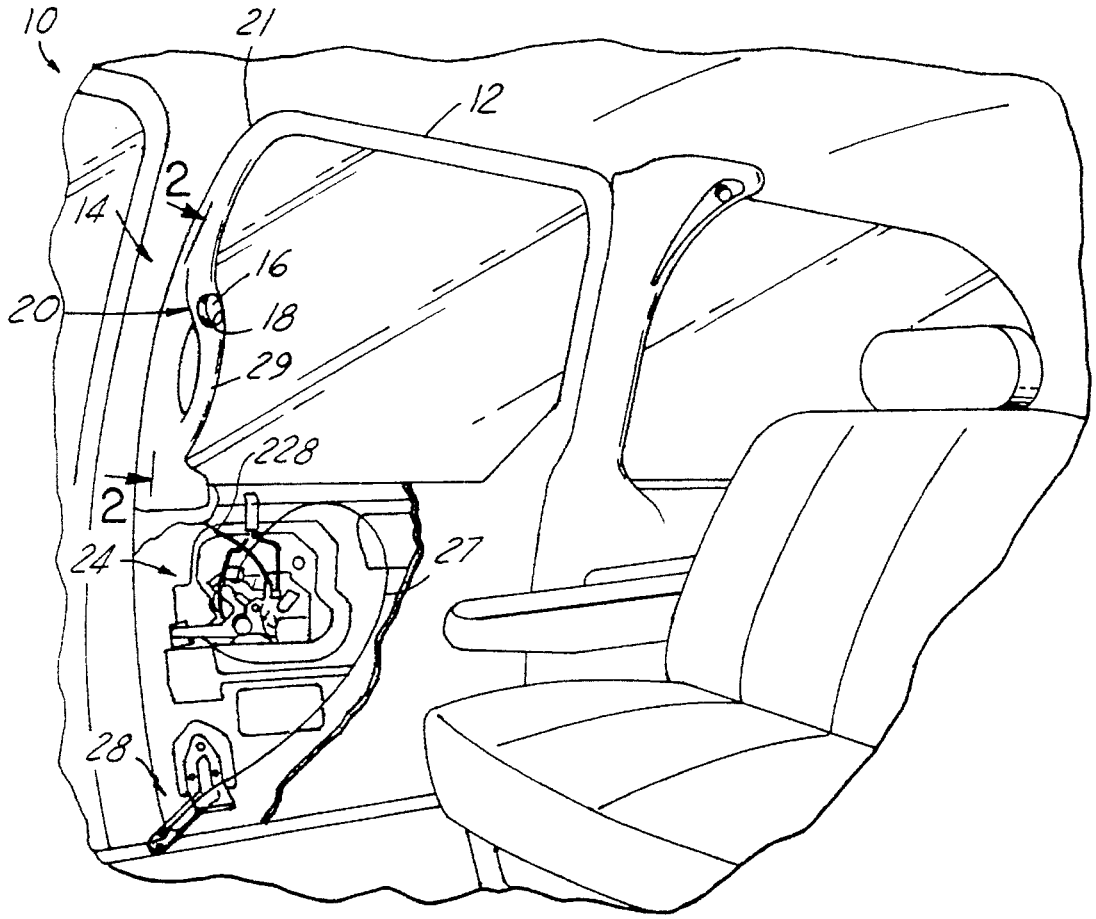
FIG. 1 is a fragmentary perspective view of a vehicle having a side sliding door embodying the invention.
Figure 5:
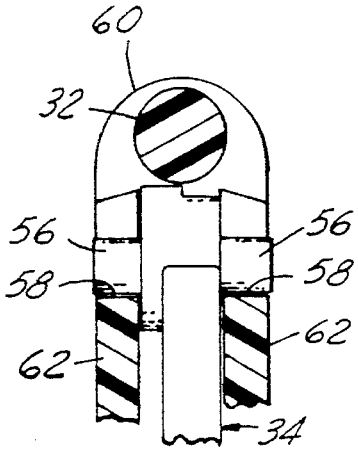
FIG. 5 is a cross-sectional view taken along the plane of the line 5—5 of FIG. 3, and looking in the direction of the arrows.

Referring now to the drawings in greater detail, FIG. 1 illustrates a vehicle body 10 having a right hand side sliding door 12 including a door latching mechanism 14. The latching mechanism 14 includes generally a thumb actuated release button 16 mounted so as to extend outwardly through an opening 18 formed in an inside handle section 20 mounted on a front side of a window frame 21, with a first cable 22 extending from inside the handle 20 to a door latch control assembly 24, a link 25 extending from the door control assembly 24 to a door latch mechanism 26, and a second cable 27 extending from the control assembly 24 to a hold-open door latch mechanism 28. A "grab" handle 29 is formed in the inside handle section 20 adjacent the opening 18.

Figure 2:
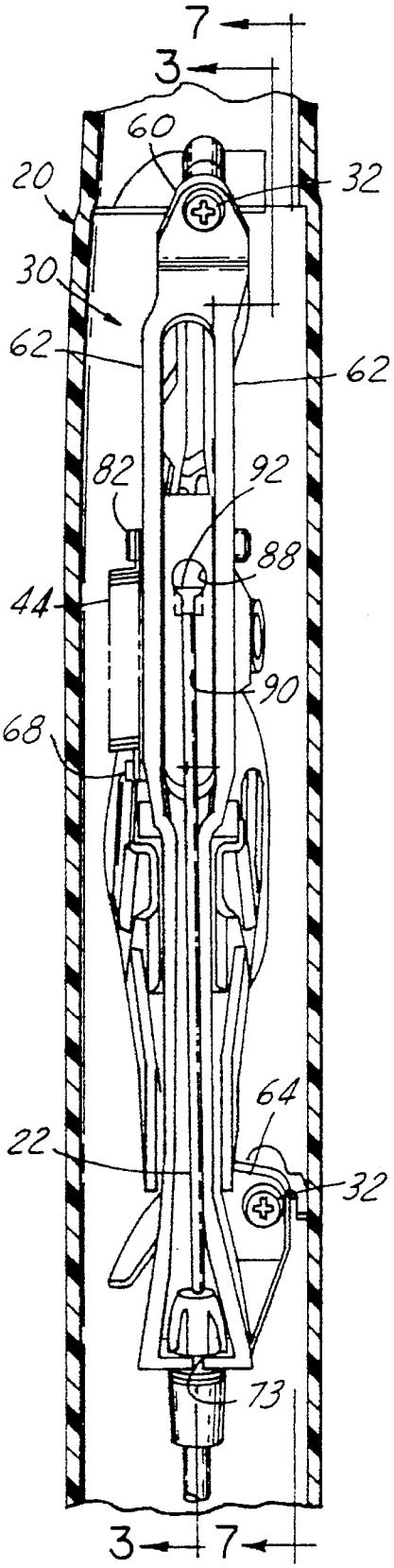
FIG. 2 is a cross-sectional view taken along the plane of the line 2—2 of FIG. 1, and looking in the direction of the arrows.
Figure 3:
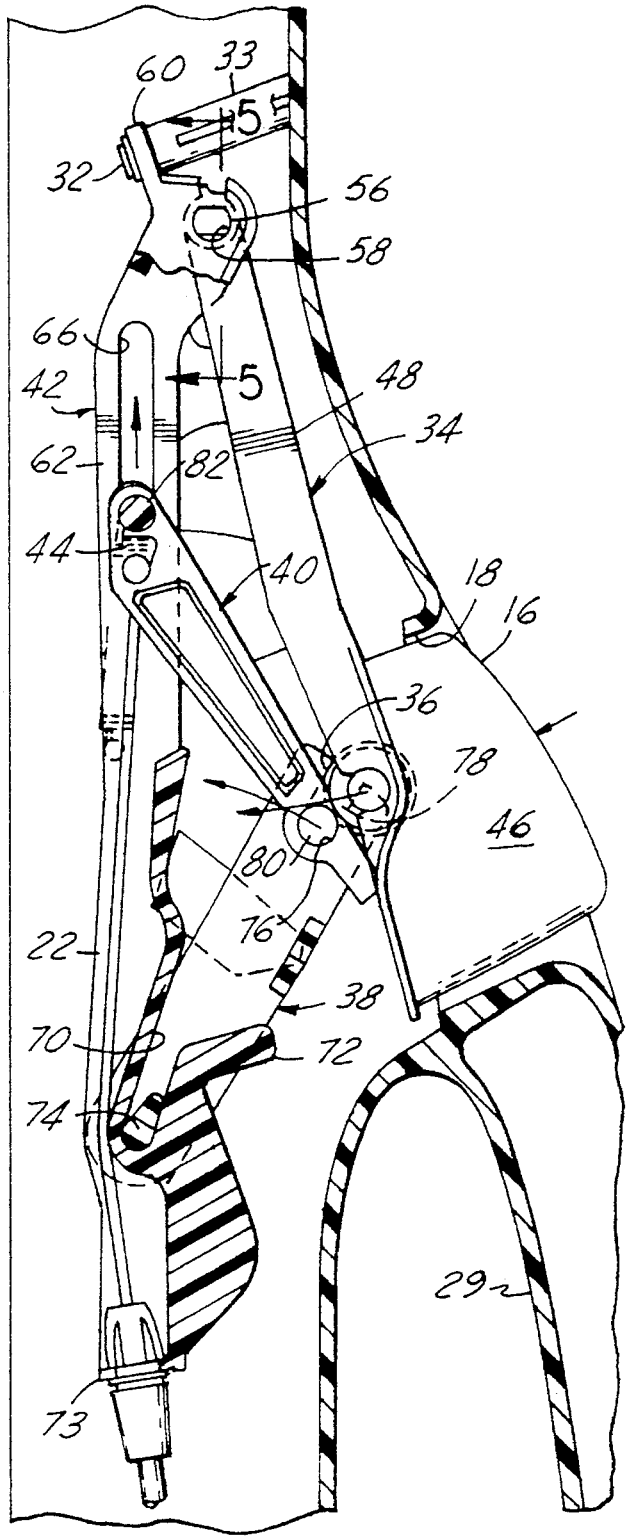
FIG. 3 is a cross-sectional view taken along the plane of the line 3—3 of FIG. 2, and looking in the direction of the arrows.
Figure 4:
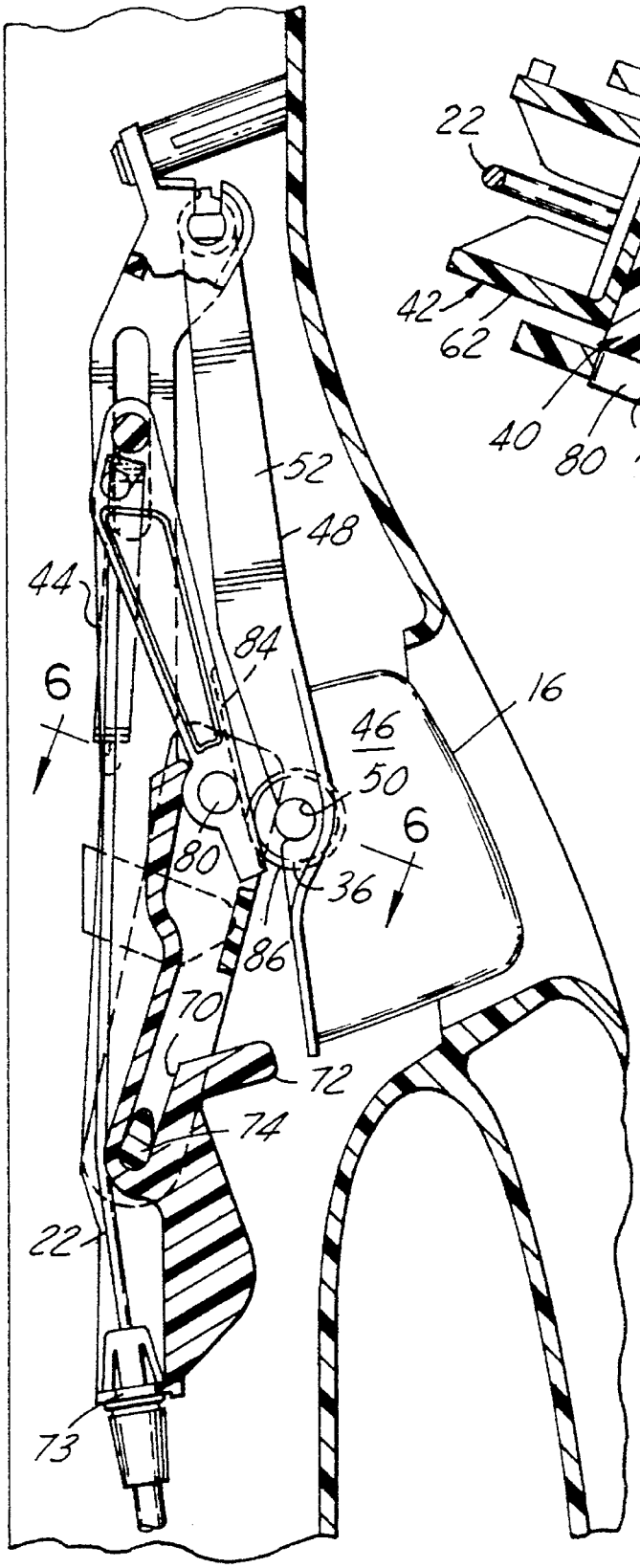
FIG. 4 is a view similar to FIG. 3, illustrating a different operational condition thereof.
Figures 7, 8:
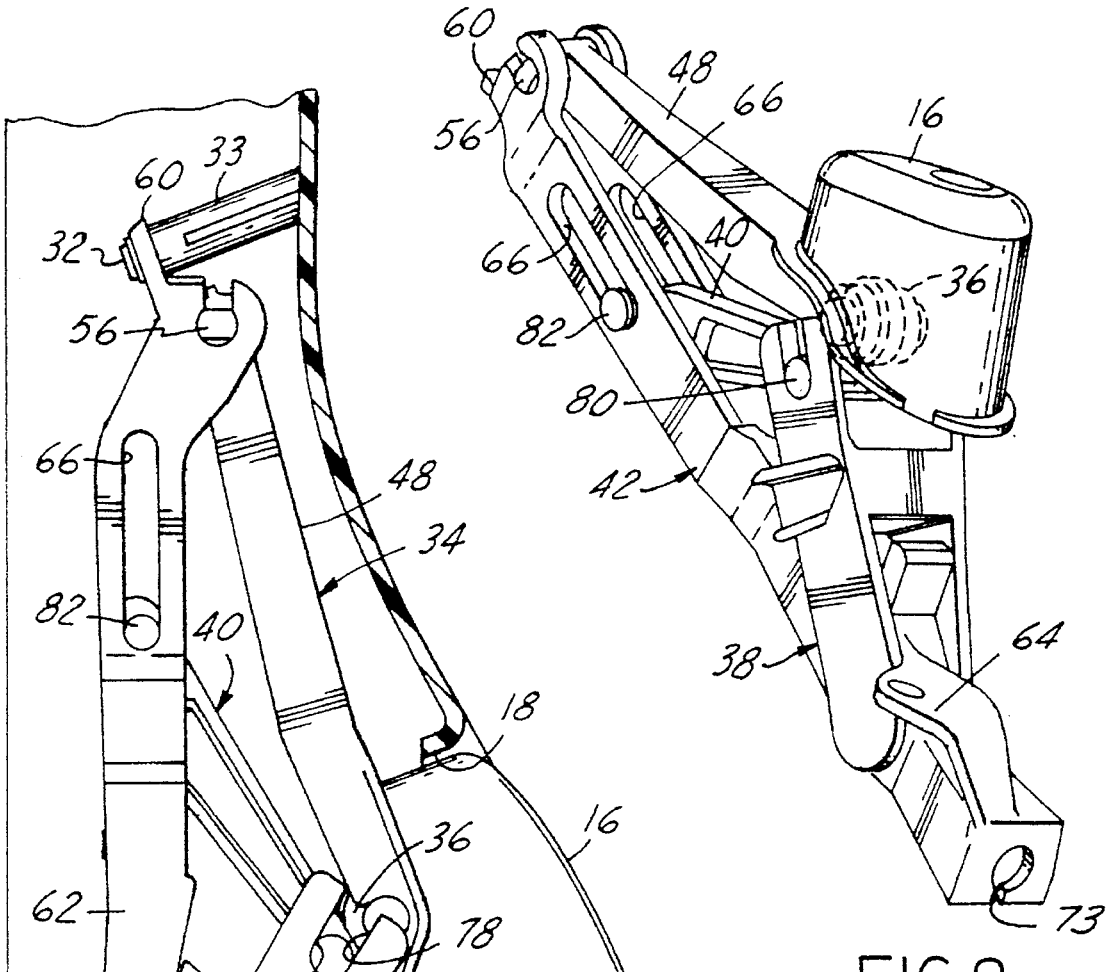
FIG. 7 is a cross-sectional view taken along the plane of the line 7—7 of FIG. 2, and looking in the direction of the arrows.
FIG. 8 is a perspective view of the FIG. 7 structure.

As shown in FIGS. 2–4, a toggle mechanism 30 is mounted inside the handle section 20, secured therein by two screws 32 fastened to molded abutments 33 (FIGS. 3 and 7). The mechanism 30 includes five molded parts that snap together to interlock, and a spring operable to urge the five parts into a relaxed condition. When manually actuated, the mechanism 30 operates on a toggle-joint principle with a variable ratio, so that the efforts required at the point of latch release is low. The six parts consist generally of an actuating member 34 having the thumb button 16 integrally molded thereon, a barrel-shaped roller 36, first and second levers 38 and 40, respectively, a base member 42, and a coil spring 44.

Figure 6:
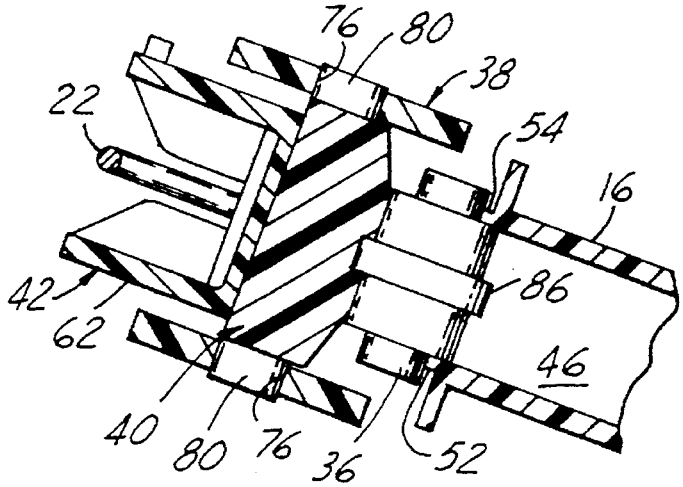
FIG. 6 is a cross-sectional view taken along the plane of the line 6—6 of FIG. 4, and looking in the direction of the arrows.

More specifically, the actuating mechanism 34 includes the release button 16 as an oval-shaped cap-like portion 46 extending freely through the opening 18, to be substantially flush with the outer surface of the thumb button 16, with an elongated channel portion 48 extending from an end of the cap-like portion 46. Oppositely disposed, aligned slots 50 are formed in the sides 52 and 54 (FIG. 6) of the channel portion 48 beneath a mid-section of the cap-like portion 46, adapted to having the roller 36 snapped into and rollingly seated therein. A pair of oppositely disposed, aligned studs 56 are formed on the distal end of the channel portion 48 adapted to snap into oppositely disposed, aligned slots 58 formed in one end of the base member 42 adjacent a perforated extension 60 (FIGS. 2 and 3) through which one of the screws 32 is extended.

The base member 42 is formed to include oppositely disposed side walls 62, with a perforated upward extension 64 (FIG. 2) formed adjacent the other end thereof, through which the second screw 32 is extended. Oppositely disposed, aligned longitudinal slots 66 are formed in the respective side walls 62. A spring retainer lug 68 is formed on one wall 62 at an intermediate location therealong. An open-ended groove 70 is formed on a predetermined incline in an upper surface of the base member 42 adjacent the upward extension 64, with a steeper extended stop member 72 formed on the inlet end of a side of the groove 70, adapted to serve as a stop for the thumb button 16. A slotted opening 73 is formed in the center of the end of the base member 42 adjacent the groove 70.

The first lever 38 is substantially H-shaped, with a cross bar 74 (FIG. 3) formed across one end thereof, adapted to seat in the bottom of the groove 70. Oppositely disposed, aligned openings 76 are formed in the sides of the lever 38 adjacent the other end thereof. A slot 78 (FIG. 7) is formed from the latter end to one of the openings 76.

The second lever 40 is formed to include a first pair of oppositely disposed, aligned studs 80 adjacent one end thereof, adapted to having one of the studs 80 inserted in one of the openings 76, and the other stud 80 snapped through the slot 78 into the other opening 76. A second pair of oppositely disposed, aligned studs 82 are formed adjacent the other end thereof, adapted to be slidably mounted in the longitudinally slots 66 of the base member 42.

A longitudinal groove 84 (FIG. 4) is formed in the center of the upper surface of the second lever 40 extending from the end adjacent the studs 80 for a predetermined length. An annular rim 86 is formed around the middle of the barrel-shaped roller 36, adapted to ride in the groove 84.

An opening 88 (FIG. 2) and an adjoining longitudinal groove 90 are formed in the center of the bottom surface of the second lever 40. The opening 88 is adapted to receive and hold a lug 92 formed on the end of the first cable 22, with the latter extending through the groove 90. As such, the cable 22 extends from the groove 90 between the side walls 62 of the base member 42, to exit through the slotted opening 73 toward the door control assembly 24.

The coil spring 44 (FIG. 2) is connected at its end coils to one of the studs 82 and the spring retainer lug 68. In its compressed condition, the coil spring 44 urges the pivotally interconnected levers 40 and 38 into a substantially A-shape, as shown in FIG. 3, thereby holding the release button 16 so as to extend through the opening 18 of the handle section 20.

Figure 9:
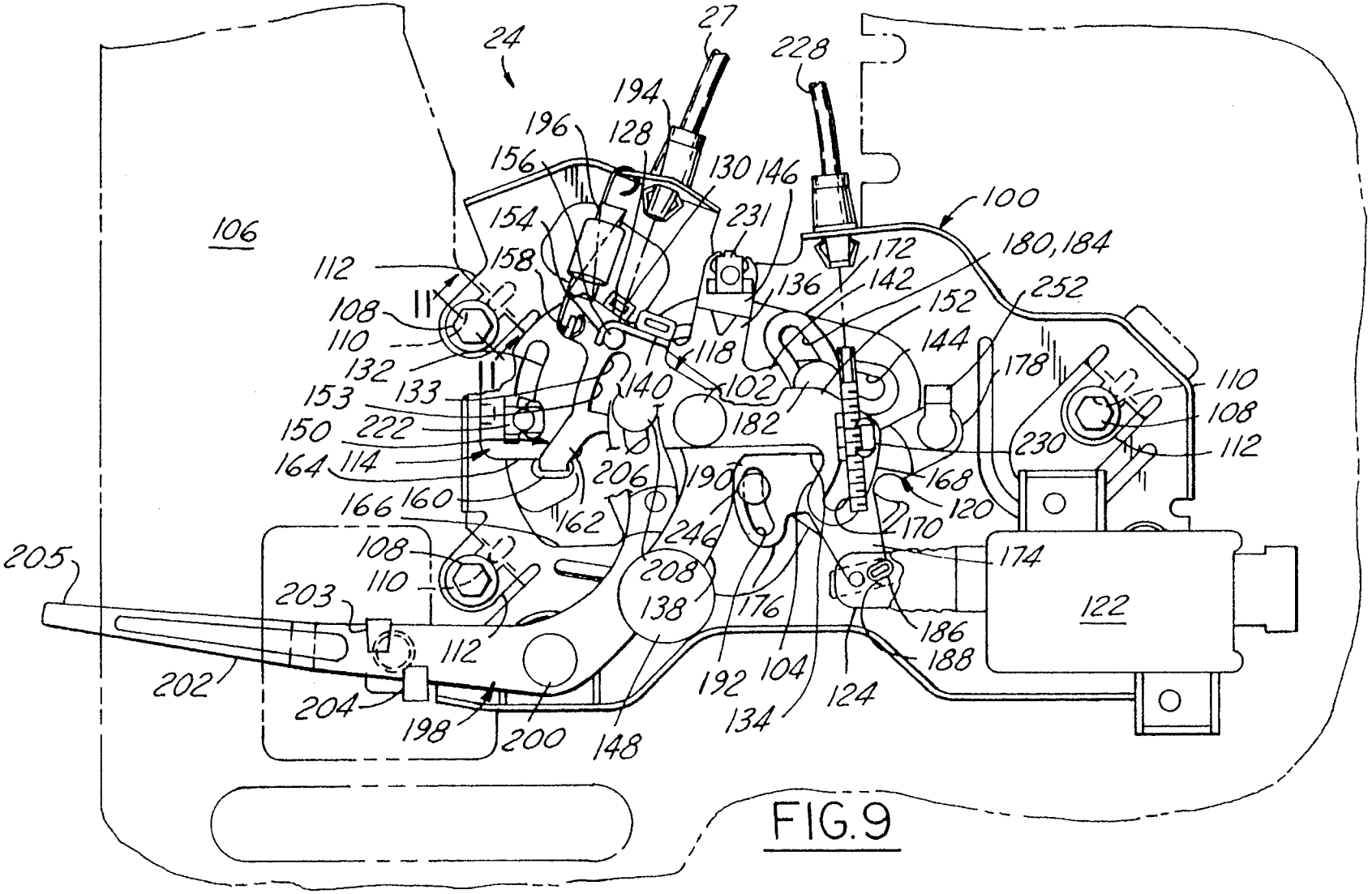
FIG. 9 is a plan view of the inventive door latch control assembly.
Figure 10:
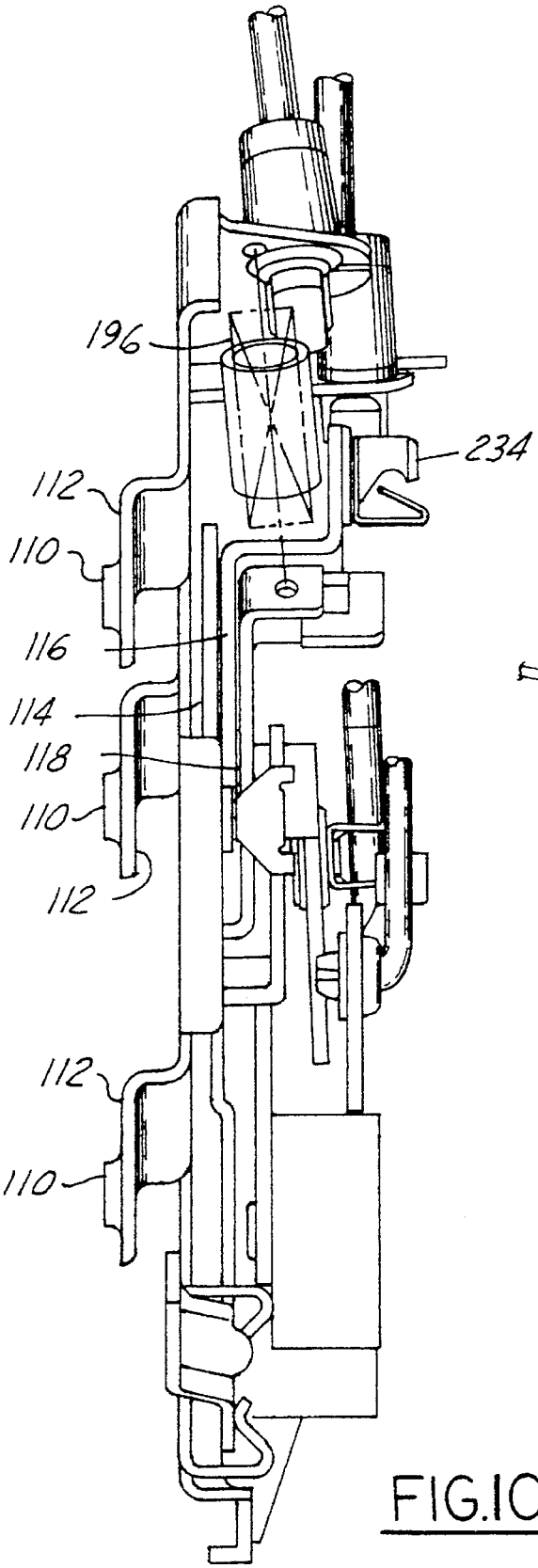
FIG. 10 is an end view of the FIG. 9 structure.
Figure 11:
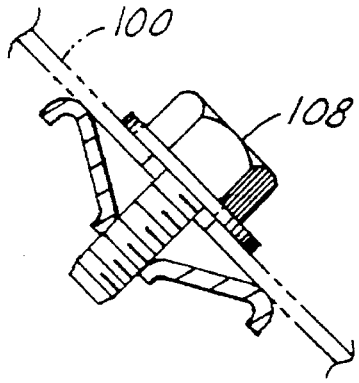
FIG. 11 is a cross-sectional view taken along the plane of the line 11—11 of FIG. 9, and looking in the direction of the arrows.

Referring now to FIG. 9, the control assembly 24 includes a mounting plate 100 having first and second fixed mounting pins 102 and 104 extending from the inner surface thereof. The plate 100 is secured to the inside of an inner panel 106 of the sliding door 12 by three screws 108 threadedly extended through threaded holes 110 formed in three mounting feet 112. An outside handle release lever 114, a latch release lever 116, and a hold-open latch release lever 118 are pivotally stacked on the first mounting pin 102. A locking lever 120 is pivotally mounted on the second mounting pin 104. A power lock actuator 122 is mounted on the plate 100 with a piston 124 extending therefrom and connected to the locking lever 120.

The outside handle release lever 114 includes an upper edge 128 adapted to at times abut against a stop member 130 formed on the plate 100. An arcuate slot 132 is formed adjacent the edge 128 in one end of the lever 114. A V-shaped slot 133 is formed in the lever 114 intermediate the arcuate slot 132 and the mounting pin 102. A leg 134 of the lever 114 extends on the opposite side of the mounting pin 102 from the slot 132 end.

The latch release lever 116 includes an upper leg 136, a lower leg 138, a stop member 140 to the left of the upper leg 136, and a right leg 142. An arcuate slot 144 is formed in the leg 142. A link mounting foot 146 is formed on the upper leg 136, and a counterweight 148 is secured to the end of the lower leg 138.

The hold-open latch release lever 118 includes a left portion 150 and a right portion 152. A V-shaped slot 153 is formed in the left portion 150. The left portion 150 is formed to include a slotted flange 154 adapted to retain a sphere 156 on the end of the cable 24. A spring retainer lug 158 is formed adjacent the flange 154. A lug 160 is formed on a lower leg 162, extending past a lower edge 164 of the outside handle release lever 114, and adapted to at times abut against a stop surface 166 formed on the plate 100. A downwardly extending leg 168 is formed at the end of the right portion 152. An arcuate slot 170 is formed in the leg 168.

The locking lever 120 includes (FIG. 9) upwardly, downwardly, leftwardly, and rightwardly extending legs 172, 174, 176 and 178, respectively. An arcuate slot 180 is formed in the upward leg 172. A pivot pin 182 extends through the arcuate slot 180, and thence through the arcuate slot 144 in the latch release lever 116, and through a further substantially V-shaped slot 184 formed in the plate 100. The leg 134 of the outside handle release lever 114 is adapted to, at times, abut against the pivot pin 182. A stop lug 186 is formed on the end of the downward leg 174, extending through a four-sided slot 188. A stepped flange 190 is formed on the leftward leg 176, and an arcuate slot 192 is formed in the flange 190.

A spring retainer hole 194 is formed in an upper edge of the plate 100. A coil spring 196 is connected between the hole 194 and the spring retainer lug 158 on the hold-open latch release lever 118.

An upwardly and leftwardly extending child guard lever 198 (FIG. 9) is pivotally connected at a mid section thereabout by a rivet 200 to the plate 100. The leftwardly extending leg portion 202 of the lever 198 is pivotable between upper and lower stop flanges 203 and 204, respectively, formed on a lower left edge of the plate 100, by manual movement of the terminal end 205 extending beyond the edge of the door 12. The upwardly extending leg portion of the lever 198 includes a slot 206 formed adjacent its distal end. A pivot pin 208 extends through each of the slot 206, and the V-shaped slots 153 and 133 of the levers 118 and 114, respectively.

An outside handle 210 (FIG. 1A) is pivotally mounted on a plate 212. The handle 210 extends through the door 12 and is pivotally connected to a suitable bracket arrangement 216 pivotally mounted in an enclosure 218. A link, represented as 220, is pivotally connected at the upper end thereof to the bracket arrangement 216, and at its lower end to a connector 222 (FIG. 9) slidably mounted in the arcuate slot 132 of the lever 114.

Figure 12:
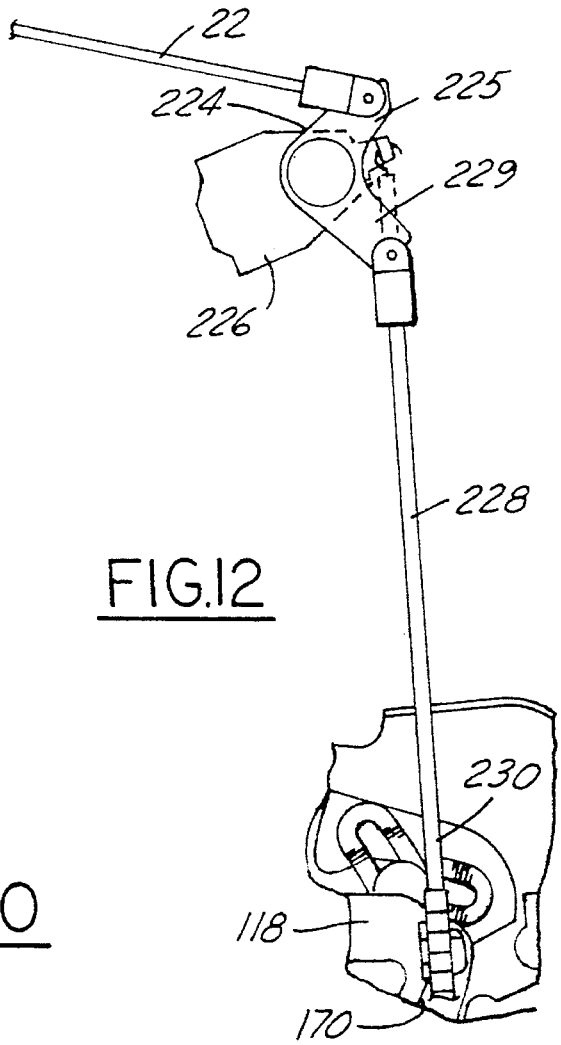
FIG. 12 is a fragmentary side elevational view of a connector portion of the FIG. 1A structure.
Figure 13:
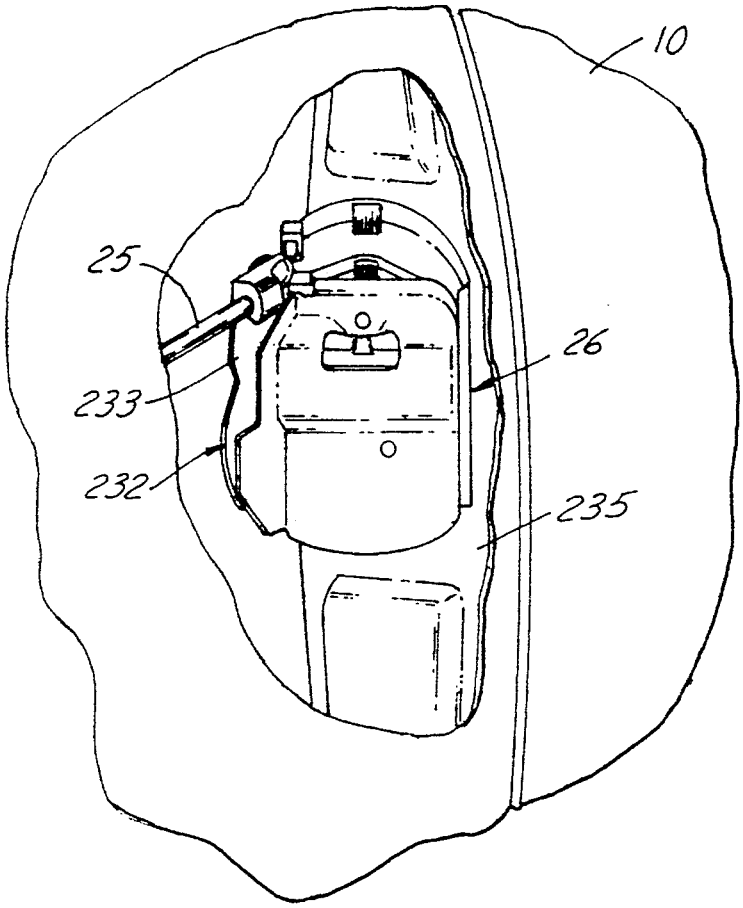
FIG. 13 is a fragmentary perspective view of a latch portion of the FIG. 1A structure mounted on a vehicle pillar.
Figure 14:
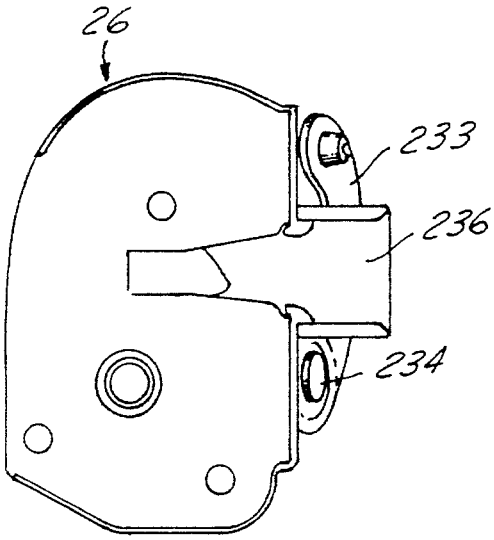
FIG. 14 is a plan view of the door closure latch assembly of FIG. 13.
Figure 15:
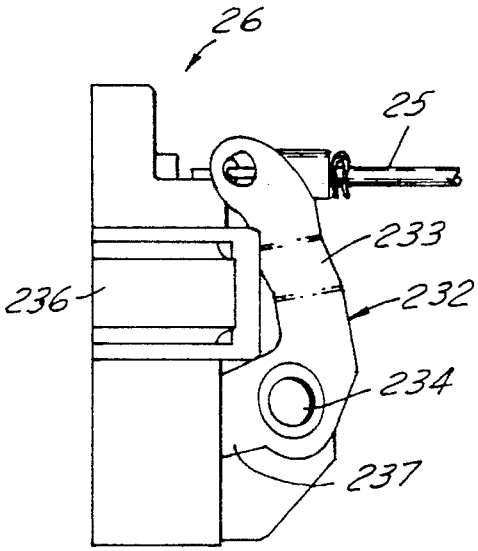
FIG. 15 is an end view of the FIG. 14 latch assembly.
Figure 16:
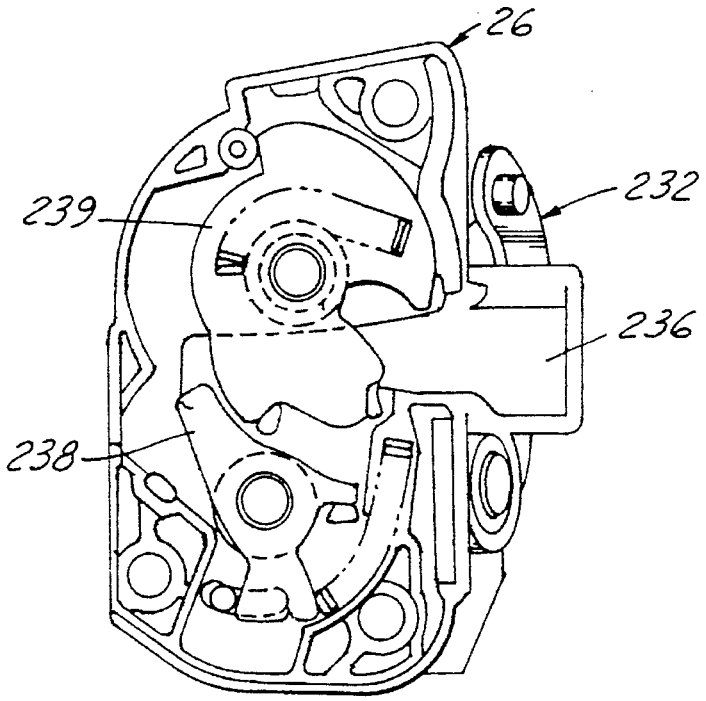
FIG. 16 is a view similar to FIG. 14 with the cover removed.

The cable 22 is connected at its lower end to one leg 225 of a bracket 224 (FIG. 12) pivotally mounted on a plate 226 secured to the door 12. A link 228 is pivotally connected at the upper end thereof to the other leg 229 of the bracket 224, and at its lower end to a connector 230 slidably mounted in the arcuate slot 170 of the hold-open lever 118.

The latch release link 25 (FIG. 1A) extends from a connector 231 (FIG. 9) pivotally connected to the upper leg 136 of the lever 116 to a release lever 232 including a leg 233 pivotally mounted on a pin 234 on the latch mechanism 26 (FIGS. 13–16). The latch mechanism 26 is operatively pivotally cooperable with a striker (not shown) secured to a center pillar 235 (FIG. 13) of the vehicle body 10. The striker is accessed by an opening 236 (FIG. 14) in the latch mechanism 26. A leg 237 (FIG. 15) of the lever 232 extends into the latch mechanism 26 adapted to unlatch a spring-loaded pawl 238 (FIG. 16) from a spring-loaded ratchet 239 (FIG. 16) to release the latter from the striker upon pulling the link 25 by the latch release lever 116.

A key cylinder link, represented as 240 in FIG. 1A, is pivotally connected at its upper end to a disk, represented as 242 (FIG. 1A), pivotally actuated by an outside door key cylinder, represented as 244, and at its lower end to a connector 246 slidably mounted in the arcuate slot 192 (FIG. 9) of the locking lever 120.

A lock/unlock link 248 (FIG. 1A) is accessible inside the vehicle body 10 at its upper end 250 through an opening (not shown) in the window frame, and connected at its lower end to a connector 252 (FIG. 9) pivotally connected to the rightwardly extending leg 178 of the locking lever 120.

Figure 17:
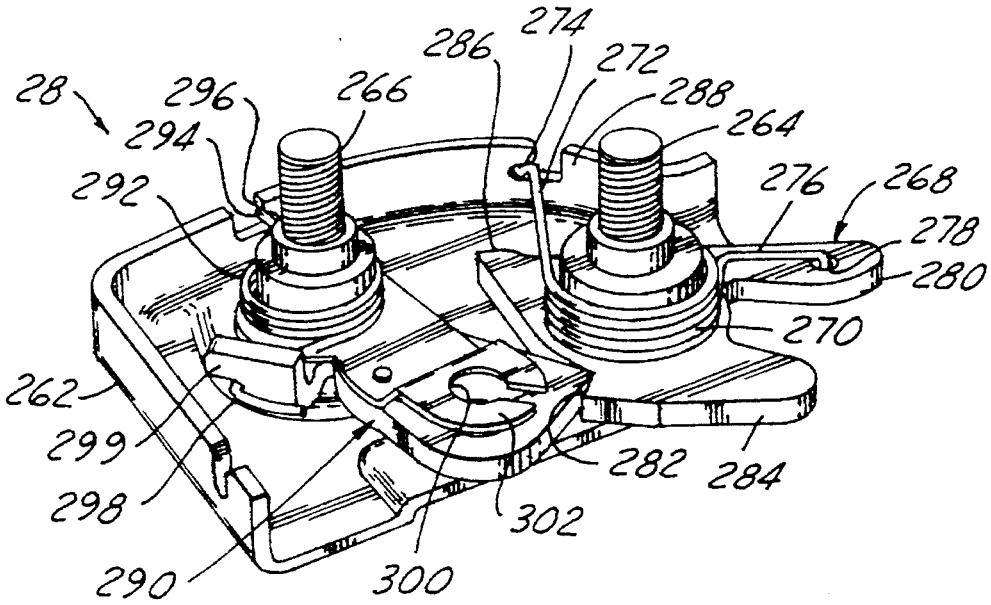
FIG. 17 is a perspective view of a hold-open latch assembly of the invention.
Figure 18:
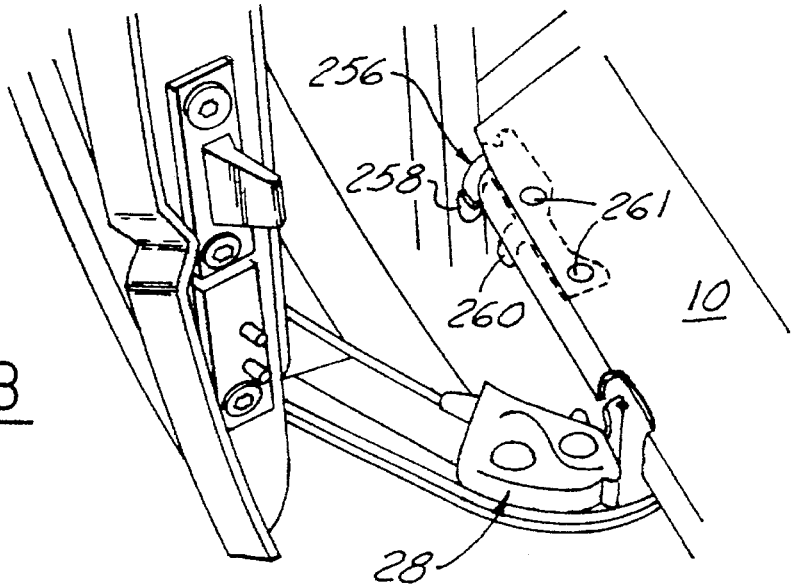
FIGS. 18 and 19 are fragmentary perspective views of hold-open latch assembly of FIG. 17 in two operational positions.
Figure 19:
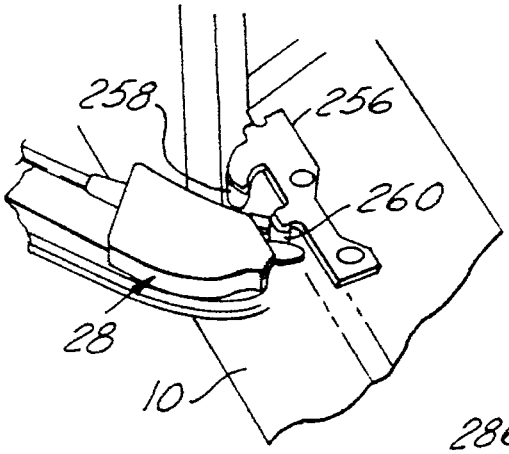
Figure 20:
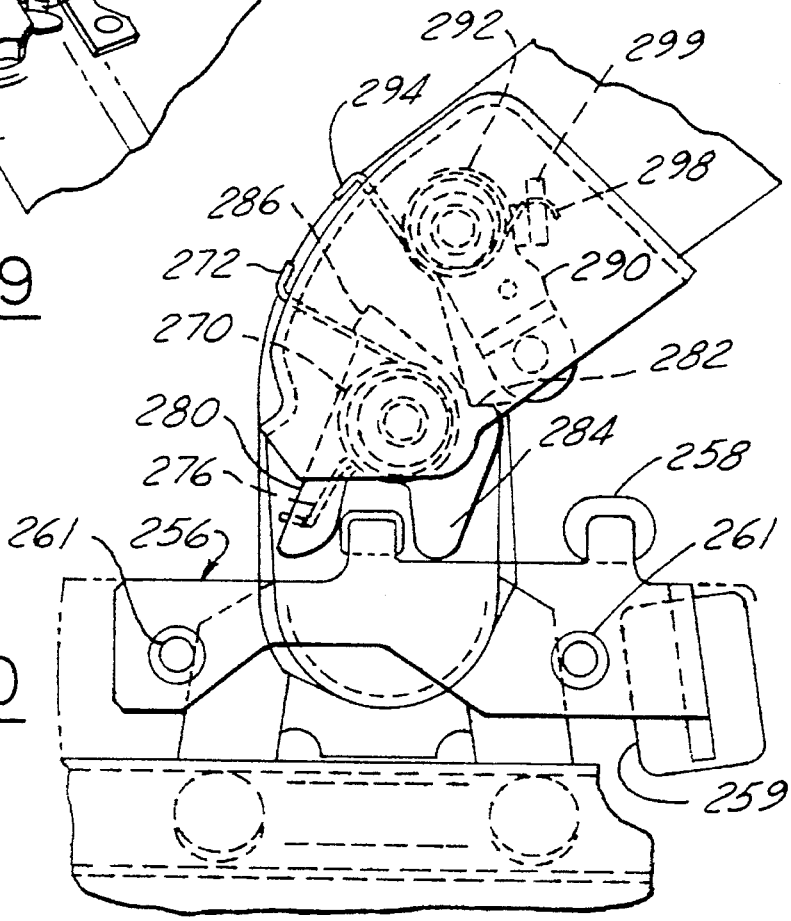
FIG. 20 is an enlarged top view of the hold-open latch assembly in its operative hold-open mode.

A bracket 256 (FIGS. 18–20), including two spaced stopper segments 258 and 259 and a striker leg 260, is secured by fasteners 261 to a lower edge portion of the vehicle body 10. The hold-open door latch mechanism 28 (FIG. 17) includes a housing 262 secured by bolts 264 and 266 to a mounting bracket 267 (FIG. 1A) secured to the bottom front portion of the side door 12 adapted to operatively cooperate with the striker leg 260. A spring loaded, U-shaped ratchet 268 is pivotally mounted around the bolt 264. A coil spring 270 is also mounted around the bolt 264, with one extended end 272 secured to an edge slot 274 on the bracket 262, and the other extended end 276 secured to a hole 278 formed adjacent an end of one leg 280 of the U-shaped latch 268. A step 282 is formed on an outer bottom part of the other leg 284 of the U-shaped latch 268. A projection 286 is formed on the base of the latch 268, adapted to be urged by the spring 270 into engagement with a flange 288 formed on an edge of the bracket 262. A spring-loaded pawl 290 is pivotally mounted around the other bolt 266. A coil spring 292 is also mounted around the bolt 266, with one extended end 294 secured to an edge slot 296 on the bracket 262, and the other extended end 298 secured to a retainer lug 299 formed on an edge of the lever 290. The spring 292 serves to urge the lever 290 into engagement with the leg 284 and at times, into engagement with the step 282. A cable-receiving slot 300 is formed in an arm 302 secured to the lever 290 for movement therewith. The slot 300 is adapted to receive an end of the cable 27 (FIG. 1A) extending from the slotted flange 154 (FIG. 9) of the hold-open latch release lever 118.

In operation, pressing the thumb button 16 to the bottom of the opening 18 collapses the A-shaped, pivotally interconnected levers 34 and 40, thereby causing the studs 82 to slide along the slot 66, extending the spring 44. During this movement, the cable 22 is pulled therealong by virtue of its connection in the opening 88 of the base member 42. The lower end of the cable 22 thus pivots the bracket 224, thereby lifting the link 228. Lifting the link 228 lifts the right portion 152 of the lever 118. Such movement urges the pivot pin 208 in the slot 206 and the V-shaped slot 153 in the lever 218 downwardly. Since the pivot pin 208 extends through to the V-shaped slot 133 in the lever 114, the latter is pivoted in a counterclockwise direction (FIG. 9) about the mounting pin 102, against the force of the spring 196 thereby lifting the right hand (FIG. 9) leg 134 of the lever 114. The leg 134 serves to lift the pin 182 along the arcuate slot 180 in the upwardly extending leg 172 of the locking lever 120, thereby lifting the right leg 142 of the latch release lever 116. This pivots the upper leg 136 of the lever 116 and, hence, the latch release link 25 to the left in FIG. 9, unlatching the latch mechanism 26 from the striker on the pillar 235 (FIG. 13), permitting the door 12 to be opened.

Alternatively, pulling the outside handle 210 (FIG. 1A) causes the inside link 220 to be moved downwardly, against the force of the spring 196 (FIG. 9) by virtue of the lower edge 164 of the left portion 150 of the lever 114 moving the lug of the lever 118. The right leg 134 of the lever 114 directly lifts the pivot pin 182 along the arcuate slot 180 of the upper leg 172 of the locking lever 120, thus lifting the leg 142 of the lever 116, and pulling the latch release link 25 to the left in FIG. 9, unlatching the latch mechanism 26 from the striker, permitting the door 12 to be opened.

Concurrently with either of the above described thumb button 16 or outside handle 210 unlatching operations, the slotted flange 154 of the hold-open latch lever 118 pulls the ball 156 downwardly, thereby pulling the cable 27. This action pivots the lever 290 away from the step 282 on the leg 284 of the latch 258, thereby freeing the spring 270 to snap the U-shaped latch 268 away from the striker leg 260.

Throughout the above unlatching operations, it is essential that the locking lever 120 be in its unlocked mode, i.e., with the lower leg 174 swung to the right in FIG. 9, with the stop lug 186 positioned against the right side of the four-sided slot 188 by action of either of the key cylinder link 240 or the lock/unlock link 248, permitting the pin 182 to travel in the arcuate slot 180, as described above.

With the locking lever 120 moved by the action of the links 240 or 248, into the locked position, i.e., with the stop lug 186 on the lower leg 174 moved leftwardly against the left side of the four-sided slot 188, this positions the pin 182 in the right side of the V-shaped slot 184 formed in the plate 100 behind the respective arcuate slots 144 and 180, preventing any upward movement of the pin 182 and, hence, preventing any movement of the lever 116 and the latch release link 25 upon movement of either of the levers 114 or 118 by actuation of either of the outside handle 210 or the thumb button 16.

With the leftwardly extending leg 202 (FIG. 9) of the child guard lever 198 manually moved downwardly at the terminal end 205 thereof, the pin 208 is positioned by the movement of the slot 206 in the left, substantially vertical portion of the V-slots 133 and 153, permitting pivotal movement of the lever 118 by the thumb button 16, without producing any movement of the latch release lever 116, thus preventing the door 12 from being opened by a child inside the vehicle.

INDUSTRIAL APPLICABILITY

It should be apparent that the invention provides a simplified, compact and efficient door latch toggle type release mechanism, with five molded parts thereof easily snapped together for pivotal operation therebetween, and readily available on the window frame to the vehicle passenger.

It should be further apparent that the invention is adaptable to being constructed as either a left hand or right hand arrangement for use on a left or right door, respectively.

While but one embodiment of the invention has been shown and described, other modifications thereof are possible within the scope of the following claims.

What is claimed is:

1. A toggle release mechanism for a vehicle door latch control assembly, the toggle release mechanism comprising a base member, a first lever having two opposite ends pivotally connected at one end thereof to said base member, a second lever having two opposite ends pivotally connected at one end thereof to the other end of said first lever and slidably connected at the other end thereof along said base member, an actuating member pivotally connected at one end thereof to said base member and rollingly connected to said one end of said second lever, and means formed on said other end of said second lever for connecting a cable thereto adapted to being pulled upon depression of said actuating member.

2. The toggle release mechanism described in claim 1, and a thumb actuated release button formed on said actuating member.

3. The toggle release mechanism described in claim 2, wherein said thumb actuated release button is an oval-shaped cap-like portion integrally molded on said actuating member.

4. The toggle release mechanism described in claim 1, and a roller rollingly connected to said actuating member for rolling cooperation with said second lever.

5. The toggle release mechanism described in claim 1, and a spring connected between said base member and said other end of said second lever.

6. The toggle release mechanism described in claim 4, wherein said first and second levers include means for being snapped together into a pivotal relationship, said actuating member and said base member include means for being snapped together into a pivotal relationship, and said roller and said actuating member include means for snapping said roller into said actuating member.

7. The toggle release mechanism described in claim 1, wherein said base member includes spaced side walls, and said cable extends from said other end of said second lever through said spaced side walls.

8. The toggle release mechanism described in claim 2, wherein said base member is fixed, and handle means for confining said actuating member relative to said base member, with an opening formed in said handle means for the extension therethrough of said thumb actuated release button.

9. The toggle release mechanism described in claim 7, and aligned slots formed in said spaced side walls, and oppositely disposed projections formed on said other end of said second lever and extending into said aligned slots.

10. The toggle release mechanism described in claim 1, wherein said means for connecting a cable is an opening formed in said other end of said second lever adapted to receive an end of said cable.

* * * * *